US009915892B2

(12) United States Patent
Sunahara et al.

(10) Patent No.: US 9,915,892 B2
(45) Date of Patent: Mar. 13, 2018

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Satoshi Sunahara, Hachioji (JP); Makoto Tokudome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/253,400

(22) Filed: Aug. 31, 2016

(65) Prior Publication Data

US 2017/0068182 A1 Mar. 9, 2017

(30) Foreign Application Priority Data

Sep. 7, 2015 (JP) ..... 2015-176064

(51) Int. Cl.

*G03G 15/08* (2006.01)
*G03G 15/09* (2006.01)
*G03G 15/16* (2006.01)

(52) U.S. Cl.

CPC ..... *G03G 15/0818* (2013.01); *G03G 15/0921* (2013.01); *G03G 15/1675* (2013.01); *G03G 15/0907* (2013.01)

(58) Field of Classification Search

CPC ..... G03G 15/0818; G03G 15/0921; G03G 15/1675; G03G 15/0907; G03G 21/0064; G03G 2221/0015

USPC ..... 399/149, 150

See application file for complete search history.

(56) References Cited

U.S. PATENT DOCUMENTS

2001/0028814 A1* 10/2001 Oba ..... G03G 15/0216 399/149
2002/0047887 A1* 4/2002 Koga ..... B41J 2/395 347/141
2004/0228656 A1* 11/2004 Kamimura ..... G03G 21/0064 399/149
2005/0214031 A1 9/2005 Hagiwara
2007/0127949 A1* 6/2007 Ueno ..... G03G 15/0241 399/175

* cited by examiner

*Primary Examiner* — Sandra Brase
(74) *Attorney, Agent, or Firm* — Canon USA, Inc. I.P. Division

(57) ABSTRACT

What is provided is an image forming apparatus in which longitudinal end portions of a developer bearing region or longitudinal end portions of an opening are respectively located outside longitudinal end portions of a transfer bias applicable region.

20 Claims, 11 Drawing Sheets

DEVELOPING DEVICE, PROCESS CARTRIDGE, AND IMAGE FORMING APPARATUS

BACKGROUND OF THE INVENTION

Field of the Invention

The present invention relates to a developing device, a process cartridge, and an image forming apparatus that employ an electrophotographic method.

Description of the Related Art

In electrophotographic image forming apparatuses such as a laser beam printer, a copying machine, first, a photosensitive drum is uniformly electrically charged by a charge unit. Then, the electrically-charged photosensitive drum is irradiated with light (e.g. laser light) corresponding to image information, thereby forming an electrostatic latent image on the photosensitive drum. Thereafter, a developer bearing member of a developing device supplies developer to the electrostatic latent image to visualize the electrostatic latent image as a developed image. Further, the developed image on the photosensitive drum is transferred onto a recording material such as a sheet to form an image on the recording material.

Conventionally, a corona charging method has popularly been used as a means for electrically charging a photosensitive drum. In recent years, a contact charging method, as typified by a charging roller capable of reducing the voltage of a power source and also reducing generation of ozone, is increasingly used.

Further, as to cleaning techniques, it is common to employ a configuration in which toner (or developer) that is not transferred and remains on a photosensitive drum is removed from a surface of the photosensitive drum by a cleaning device and then stored as waste toner in the apparatus. However, from the points of view of environmental protection, efficient use of resources, and apparatus size reduction, it is desirable not to produce waste toner. In view of the foregoing, U.S. Patent Publication Application No. 2005/0214031 discusses a method whereby residual untransferred toner that is not transferred onto a recording material and remains on a photosensitive drum is cleaned by a developing device simultaneously with development. In this method, the residual untransferred toner on the photosensitive drum can be collected by the developing device and reused. This method is known as a cleanerless method.

However, in a case where a contact charging member is used in a cleanerless image forming apparatus, toner remaining on a photosensitive drum after passing through a transfer position sometimes adheres to the contact charging member. A contaminated contact charging member may adversely affect image formation.

SUMMARY OF THE INVENTION

Aspects of the present invention are directed to a developing device, a process cartridge, and an image forming apparatus that are capable of reducing contamination of a contact charging member.

According to an aspect of the present invention, an image forming apparatus includes an image carrying member, charging member configured to come into contact with the image carrying member and electrically charge a surface of the image carrying member, a developer bearing member configured to collect developer remaining on the image carrying member after a developed image formed on the image carrying member has been transferred onto a recording material, and a transfer member configured to transfer the developed image onto the recording material, wherein the developer bearing member has a developer bearing region that bears developer, wherein the transfer member has a transfer bias applicable region to which a transfer bias is applicable, and wherein, in a longitudinal direction of the developer bearing member, end portions of the developer bearing region are respectively located outside end portions of the transfer bias applicable region.

According to another aspect of the present invention, an image forming apparatus includes an image carrying member, a charging member configured to come into contact with the image carrying member and electrically charge a surface of the image carrying member, a developing device including a developer bearing member configured to bear developer, and an opening through which stored developer is supplied to the developer bearing member, the developing device collecting developer remaining on the image carrying member after a developed image formed on the image carrying member has been transferred onto a recording material, and a transfer member configured to transfer the developed image onto the recording material, wherein the transfer member has a transfer bias applicable region to which a transfer bias is applicable, and wherein, in a longitudinal direction of the developer bearing member, end portions of the opening are respectively located outside end portions of the transfer bias applicable region.

According to yet another aspect of the present invention, a developing device configured to collect developer remaining on an image carrying member after a developed image formed on the image carrying member has been transferred onto a recording material, includes a developer bearing member having a developer bearing region that bears developer, and a frame member configured to store developer to be supplied to the developer bearing member, wherein, in a longitudinal direction of the developer bearing member, end portions of the developer bearing region are respectively located outside end portions of a transfer bias applicable region to which a transfer bias is applicable.

According to yet another aspect of the present invention, a developing device configured to collect developer remaining on an image carrying member after a developed image formed on the image carrying member has been transferred onto a recording material, includes a developer bearing member configured to bear developer, and a frame member including an opening and configured to store developer to be supplied to the developer bearing member, wherein, in a longitudinal direction of the developer bearing member, end portions of the opening are respectively located outside end portions of a transfer bias applicable region to which a transfer bias is applicable.

Further, an additional aspect of the present invention provides a developing device, a process cartridge, and an image forming apparatus.

Further features of the present invention will become apparent from the following description of exemplary embodiments with reference to the attached drawings.

BRIEF DESCRIPTION OF THE DRAWINGS

FIG. 5 illustrates a development opening of a development chamber, a longitudinal width of the development opening, end portion seals, and the like.

DESCRIPTION OF THE EMBODIMENTS

Figure 1:
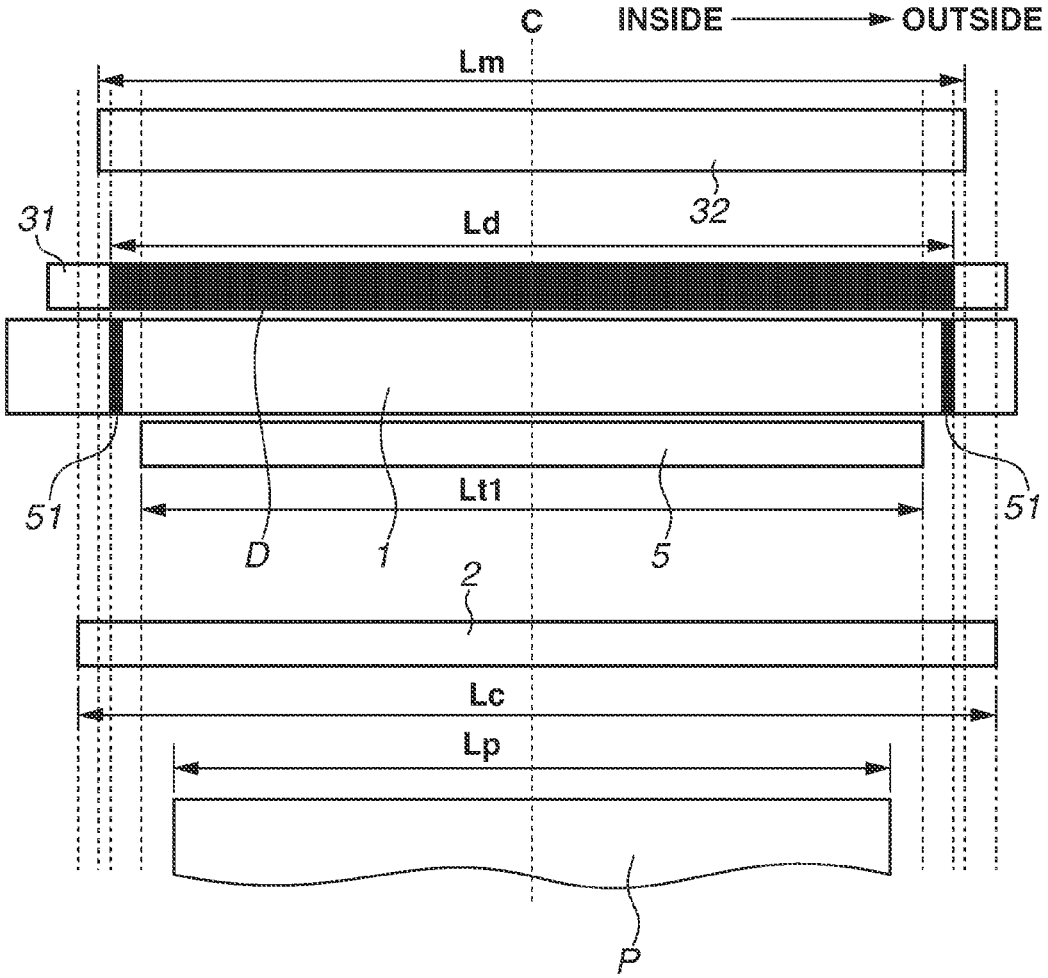
FIG. 1 illustrates a positional relationship between a charging roller, a development sleeve, a photosensitive drum, and a transfer roller according to a first exemplary embodiment in a longitudinal direction.

Exemplary embodiments of the present invention will be described in detail below with reference to the drawings. It should be noted that dimensions, materials, shapes, relative locations, etc. of components described in the following exemplary embodiments should be modified as appropriate according to the configuration of an apparatus to which the present invention is applied and depending on various conditions. In other words, the exemplary embodiments described below are not intended to limit the scope of the invention.

In the exemplary embodiments described in the present specification, a process cartridge that includes at least an image carrying member is employed. In many cases, the process cartridge is integrally formed of a charge unit, a developing unit or a cleaning unit, and an image carrying member, and configured to be attachable to and detachable from an apparatus main body of an image forming apparatus.

The apparatus main body herein is an image forming apparatus configuration from which at least the process cartridge is excluded. Further, a developing device may be configured to be separately attachable to and detachable from the apparatus main body. In this case, the apparatus main body is an image forming apparatus configuration from which the developing device is excluded.

The developing device herein is a developing device that includes at least a developer bearing member. In many cases, the developing device is integrally formed of a developer bearing member, a development frame member supporting the developer bearing member, and related components, and configured to be attachable to and detachable from an apparatus main body of an image forming apparatus.

A first exemplary embodiment will be described below. In the first exemplary embodiment, an image forming apparatus configured to simultaneously perform development and collection (so-called cleanerless system) using magnetic one-component developer will be described.

The cleanerless system is a system whereby developer remaining on an image carrying member such as a photosensitive drum, after a developed image formed on the image carrying member is transferred onto a recording material, is collected by a developer bearing member. As one form of the system, in the present exemplary embodiment, the developer bearing member simultaneously performs development of an electrostatic image and collection of residual developer.

A configuration in which a cleaning device is placed before a surface of an image carrying member, from which an image has been transferred, reaches a position where the surface of the image carrying member faces a developer bearing member and cleans the surface of the image carrying member is not included in the cleanerless system.

(Configuration of Image Forming Apparatus)

First, an image forming apparatus configured to simultaneously perform development and collection will be described with reference to FIG. 2.

The image forming apparatus according to the present exemplary embodiment mainly includes a photosensitive drum 1 as an image carrying member, a charging roller 2 as a charge unit, a developing device 3, a laser beam scanner 4 as an exposure unit, a transfer roller 5 as a transfer member, and a fixing device 6.

In the present exemplary embodiment an attachable and detachable process cartridge formed by integrating the photosensitive drum 1, the charging roller 2, the developing device 3, and the like is used.

The photosensitive drum 1 according to the present exemplary embodiment is a negative-polarity organic photoconductor (OPC) photosensitive member having a diameter of 24 mm. The photosensitive drum 1 is provided to be rotatable in a direction indicated by an arrow R1 specified in FIG. 2 at a peripheral speed (processing speed, printing speed) of 100 mm/sec. Hereinafter, the direction of a rotation axis of the photosensitive drum 1 is defined as a longitudinal direction. In the present exemplary embodiment, the longitudinal direction of the photosensitive drum 1 is the same direction as the longitudinal direction of a development sleeve 31.

The charging roller 2 electrically charges a surface of the photosensitive drum 1. The charging roller 2 is a conductive elastic roller and includes a core metal 2*a* and a conductive elastic layer 2*b* covering the core metal 2*a*. The charging roller 2 is pressed against the photosensitive drum 1 with a predetermined pressing force. A portion of the surface of the photosensitive drum 1 that is pressed by the charging roller 2 will be referred to as a charging portion c. Further, the charging roller 2 is driven and rotated by the rotation of the photosensitive drum 1.

Further, the image forming apparatus according to the present exemplary embodiment includes a charging power source that applies a charging bias to the charging roller 2. The charging power source applies a direct-current voltage to the core metal 2*a* of the charging roller 2. A value of the direct-current voltage is set to such a value that a difference in potential between the surface of the photosensitive drum 1 and the charging roller 2 becomes equal to or greater than an electric discharge starting voltage. More specifically, a direct-current voltage of −1300 V is applied as the charging bias by the charging power source. At this time, the potential (dark portion potential) of the surface of the photosensitive drum 1 is uniformly charged at −700 V.

The laser beam scanner 4 includes a laser diode, a polygon mirror, and the like. The laser beam scanner 4 outputs laser light F, an intensity of which is modulated to correspond to time-series electric digital pixel signals of target image information, and scans and exposes the electrically charged surface of the photosensitive drum 1 with the laser light F. A laser power of the laser beam scanner 4 is adjusted in such a manner that the surface potential (exposed portion potential: VL) of the photosensitive drum 1 becomes −150 V in a case where the entire surface of the photosensitive drum 1 is exposed with the laser light F.

The developing device 3 includes a development chamber 301 and a toner storing chamber 300. The development chamber 301 is formed of a first frame member 3A, and the toner storing chamber 300 is formed of a second frame member 3B. A feeding opening Q that communicates the development chamber 301 with the toner storing chamber 300 is formed. Further, the development chamber 301 has a development opening S (not illustrated) on a side that faces the photosensitive drum 1. The development sleeve 31 as a developer bearing member 34 (not illustrated in FIG. 2), and a regulating blade 33 as a regulating member are attached to correspond to the development opening S. The toner storing chamber 300 stores magnetic toner t as developer, and further includes a feeding member 30 for feeding the magnetic toner t.

The development sleeve 31, which is the developer bearing member 34, has a configuration as described below. Specifically, a conductive elastic layer is provided to a surface of an aluminum tube. In the tube, a magnet roller 32, which is a magnetic field generating member, is fixed at a predetermined position in such a manner that the magnet roller 32 is contained in the development sleeve 31.

The regulating blade 33 is formed by fixing a stainless-steel (SUS) plate to a support plate and is brought into contact with the development sleeve 31.

The feeding member 30 is formed by forming a central shaft with a rigid resin and fixing a flexible sheet member (polyethylene terephthalate (PET) is used in the present exemplary embodiment) to the shaft. A front edge of the sheet member is bent and distorted due to interference with the container while rotating, and the flexure of the sheet is released at the time when the sheet reaches the development opening S, whereby the feeding member 30 plays the role of feeding the magnetic toner t from the toner storing chamber 300 to the development chamber 301.

The magnetic toner t fed to the development chamber 301 is attracted to a surface of the development sleeve 31 due to the magnetic force of the magnet roller 32, which is the magnetic field generating member, contained in the development sleeve 31. A region on the surface of the development sleeve 31 that is coated with the magnetic toner t having passed through the portion where the development sleeve 31 is in contact with the regulating blade 33 will be referred to as a developer bearing region D. The magnetic toner t has a constant triboelectric charge and is negatively charged. Then, a development bias applied across the development sleeve 31 and the photosensitive drum 1 by a development bias applying power source causes the magnetic toner t to visualize an electrostatic latent image on the photosensitive drum 1 at a development portion a. In the present exemplary embodiment, the value of the development bias is set to −350 V. The development portion a is a region on the surface of the photosensitive drum 1 that faces the development sleeve 31. The development sleeve 31 supplies the developer to the region.

Figure 5:
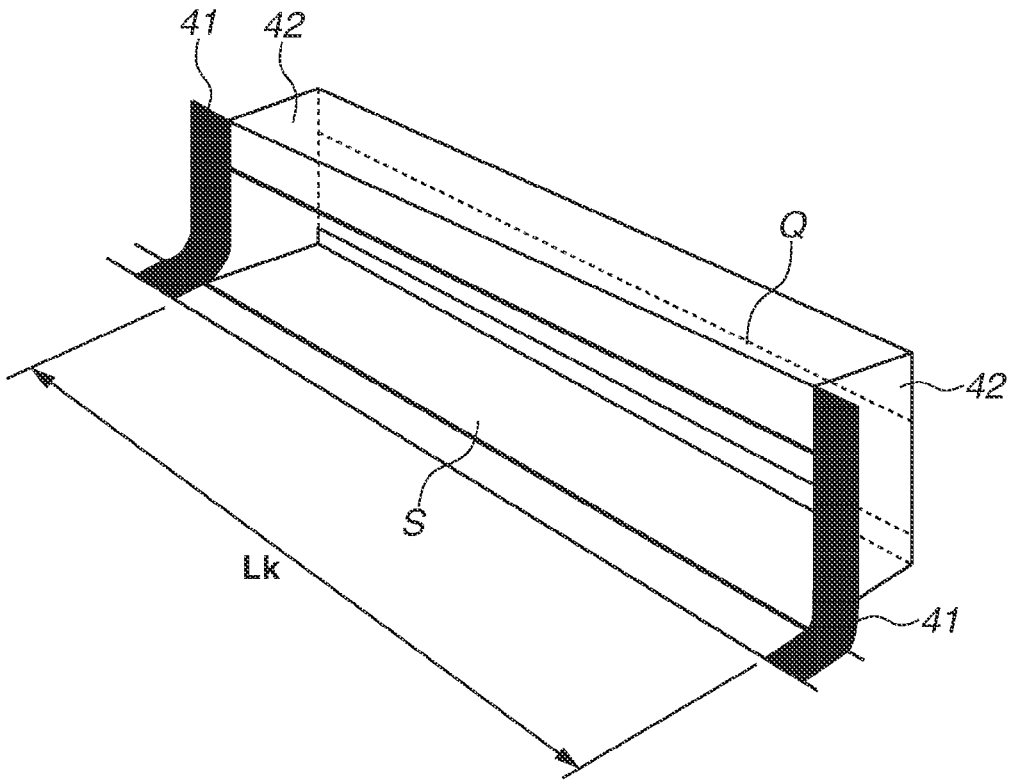

FIG. 5 is a perspective view illustrating the development chamber 301 to which the development sleeve 31 and the development blade 33 are not yet attached. In FIG. 5, a portion indicated by a thick line is the development opening S located to face the photosensitive drum 1. The feeding opening Q (most part is indicated by a dotted line) for communicating the development chamber 301 to the toner storing chamber 300 is formed to face the development opening S. The development opening S is a region where the development sleeve 31 is to be attached. End portion seals 41 are disposed outside the development opening S to seal the development opening S so that the magnetic toner t does not leak from the development chamber 301. Further, walls 42 are respectively provided to longitudinal end portions of the development chamber 301. The longitudinal width of the development opening S will be denoted by Lk. In the present exemplary embodiment, the longitudinal direction of the development opening S is the same direction as the longitudinal direction of the development sleeve 31.

Figure 6:
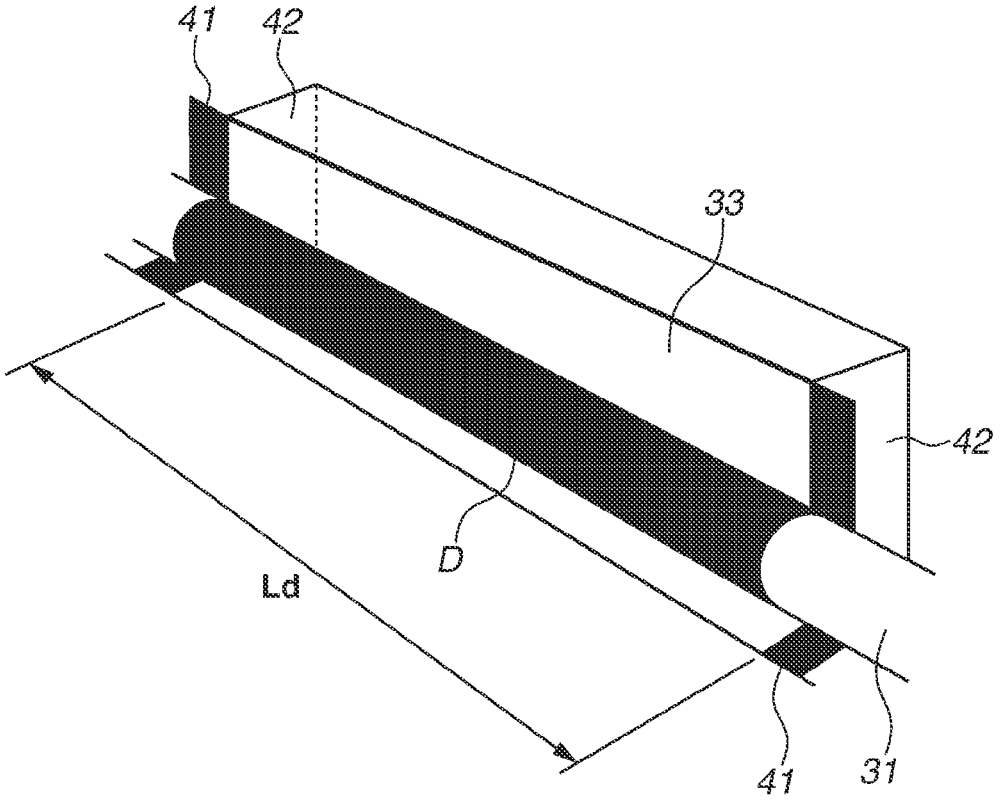
FIG. 6 illustrates a width of a developer coating on the developer bearing member in a state where the developer bearing member and a development blade are attached to the development chamber.

FIG. 6 is a perspective view illustrating the development chamber 301 to which the development sleeve 31 and the development blade 33 have been attached. A region on the development sleeve 31 that faces the development opening S is the developer bearing region D described above, because the magnetic toner t is supplied from the development chamber 301 to the region. On the other hand, the magnetic toner t is not supplied to regions on the developer bearing member 34 that are in contact with the end portion seals 41, because the regions are sealed. The longitudinal length of the developer bearing region D that is coated with the magnetic toner t is denoted by Ld. In the present exemplary embodiment, the longitudinal length Lk of the development opening S is the same as the longitudinal length Ld of the developer bearing region D. Further, in the present exemplary embodiment, the longitudinal direction of the developer bearing region D is the same direction as the longitudinal direction of the development sleeve 31.

The transfer roller 5 is provided as a transfer member and has an intermediate resistance. The transfer roller 5 is pressed against the photosensitive drum 1 with a predetermined pressure. The transfer roller 5 according to the present exemplary embodiment includes a core metal 5*a* and an intermediate-resistance foam layer 5*b* covering the core metal 5*a*. The roller resistance value is 5×10^8Ω. A voltage of +2000 V is applied to the core metal 5*a* to transfer a toner image formed on the photosensitive drum 1 onto a sheet P as a transfer material (recording material). As illustrated in FIG. 2, a portion of the surface of the photosensitive drum 1 that is pressed by the transfer roller 5 will be referred to as a transfer portion b.

A range in which application of a voltage to the transfer member has an effect on the photosensitive drum 1 will be referred to as a transfer bias applicable region of the transfer member. The transfer bias applicable region is located to face the transfer portion b of the photosensitive drum 1. Further, the longitudinal length of the transfer bias applicable region is approximately the same as the width of the foam layer 5*b* of the transfer roller 5. In the present exemplary embodiment, the longitudinal direction of the transfer bias applicable region is the same direction as the longitudinal direction of the development sleeve 31.

The fixing device 6 applies heat and pressure to a sheet P that has passed through the transfer portion b and onto which a toner image is transferred, thereby fixing the toner image onto the sheet P. Thereafter, the sheet P to which the toner image is fixed is discharged to the outside of the image forming apparatus.

(Image Formation Process)

Figure 2:
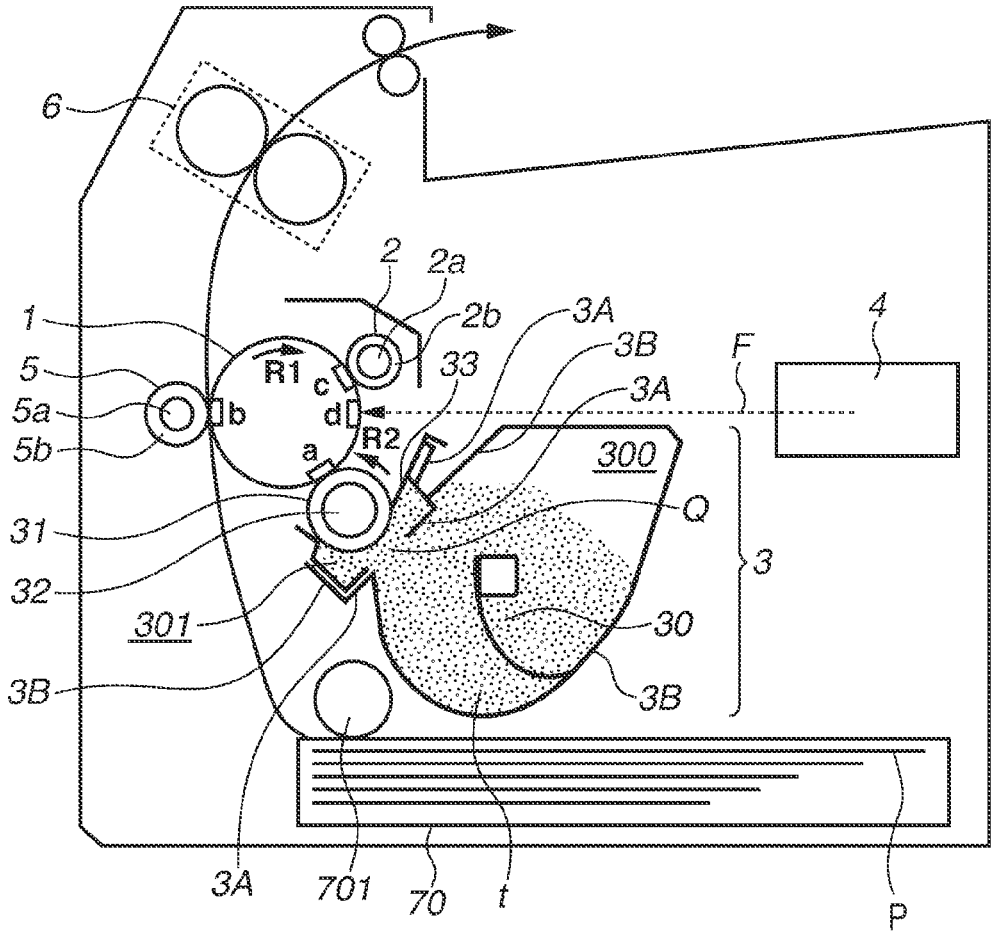
FIG. 2 is a cross sectional view illustrating an image forming apparatus according to the first exemplary embodiment.

The following briefly describes an image formation process with reference to FIG. 2. First, when a print signal is input to a controller of the apparatus main body of the image forming apparatus, the image forming apparatus starts an image formation operation. Then, each driving unit starts operating at a predetermined timing, and a voltage is applied. The rotated and driven photosensitive drum 1 is uniformly charged by the charging roller 2. The uniformly charged photosensitive drum 1 is exposed to the laser light F emitted from the laser beam scanner 4, and an electrostatic latent image is formed on the surface of the photosensitive drum 1. Thereafter, toner is supplied by the development sleeve 31 to visualize the electrostatic latent image as a toner image.

Meanwhile, a sheet P is separated and fed from a transfer material storing unit 70 via a transfer material feeding unit 701. The sheet P is fed to the transfer portion b in synchronization with the timing of the formation of a toner image onto the photosensitive drum 1. Consequently, the visualized toner image on the photosensitive drum 1 is transferred onto the sheet P by the action of the transfer roller 5. The sheet P as a transfer material to which the toner image is transferred is conveyed to the fixing device 6. At the fixing device 6, the unfixed toner image on the sheet P is fixed to the sheet P by heat and pressure. Thereafter, the sheet P is discharged to the outside of the image forming apparatus by a discharging roller, etc.

(Reduction of Contamination of Charging Roller in Cleanerless System)

Figure 3:
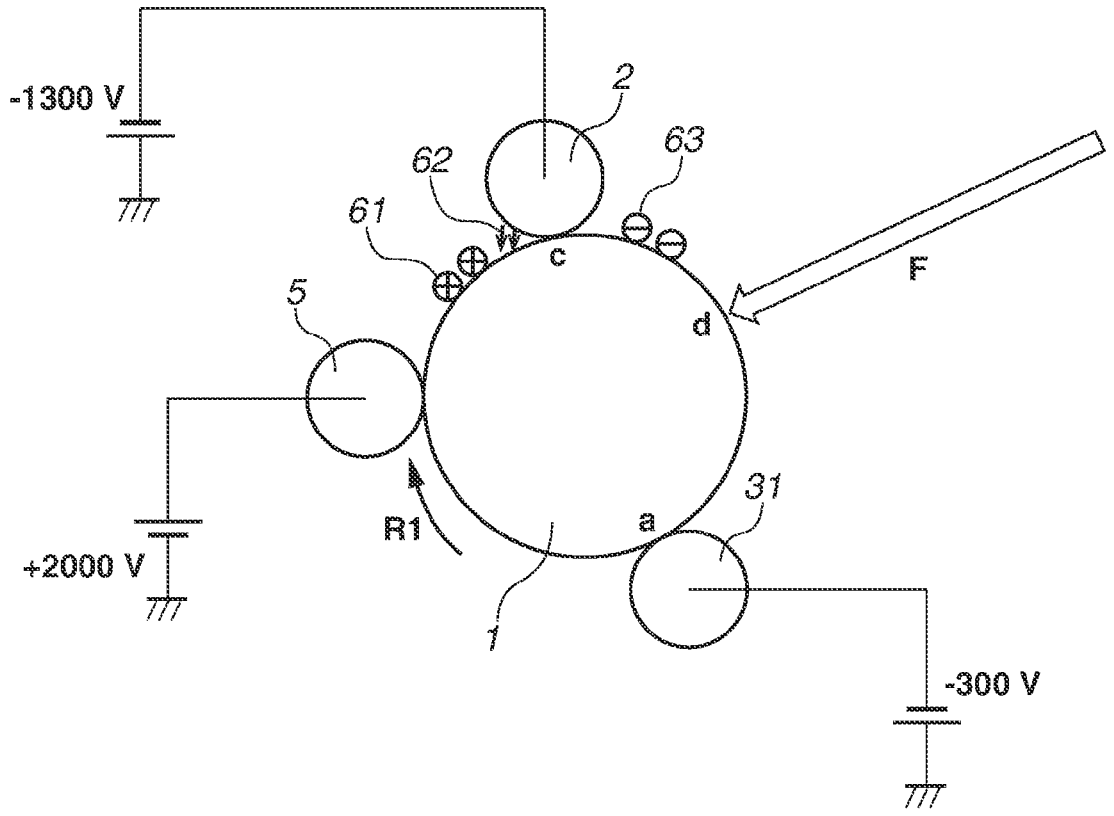
FIG. 3 illustrates how toner having passed through a transfer portion is electrically charged to a normal polarity as the toner passes through a charging portion, and then collected by a developer bearing member.

The following describes the cleanerless system according to the present exemplary embodiment in detail with reference to FIG. 3. In the present exemplary embodiment, a so-called cleanerless system is employed that does not include a cleaning member for removing from the photosensitive drum 1 residual untransferred toner that is not transferred and remains on the photosensitive drum 1.

Residual untransferred toner that remains on the photosensitive drum 1 after the transfer step is positively charged as a result of application of the transfer/print bias described above (toner 61 in FIG. 3). However, the residual untransferred toner is negatively charged by a discharge 62 at a void portion immediately before reaching the charging portion c of the surface of the photosensitive drum 1 with respect to the charging roller 2 (toner 63 in FIG. 3). At this time, the surface of the photosensitive drum 1 is charged to −700 V. The negatively charged residual untransferred toner does not adhere to the charging roller 2 and passes through the charging portion c due to the relationship of the difference in potential (surface potential of photosensitive drum 1=−700 V, potential of charging roller 2=−1300 V).

The negatively charged residual untransferred toner having passed through the charging portion c reaches a laser irradiation position d on the surface of the photosensitive drum 1 that is to be irradiated with the laser light F. The amount of the residual untransferred toner is not large enough to block the laser light F of the exposure unit and thus does not affect the step of forming an electrostatic latent image on the photosensitive drum 1. The toner that has passed through the laser irradiation position d and is at an unexposed portion (the surface of the photosensitive drum 1 that is not irradiated with the laser light F) is collected by the development sleeve 31 at the development portion a, because the surface potential of the non-image portion of the photosensitive drum 1 is −700 V whereas the development bias applied to the development sleeve 31 is −350 V. This difference in potential causes the toner to move from the surface of the photosensitive drum 1 to the surface of the development sleeve 31 and is then collected at the developing device 3.

On the other hand, the toner that has passed through the laser irradiation position d and is at the exposed portion (the surface of the photosensitive drum 1 that is irradiated with the laser light F) is not collected by the electrostatic force and continues to exist on the photosensitive drum 1. However, some of the toner may be collected by the developing device 3 due to a physical force originating from the difference in peripheral speed between the development sleeve 31 and the photosensitive drum 1. The toner that is not transferred onto the sheet P and remains on the photosensitive drum 1 is mostly collected by the developing device 3. Then, the toner collected by the developing device 3 is mixed with toner remaining in the developing device 3 and reused.

Figure 4:
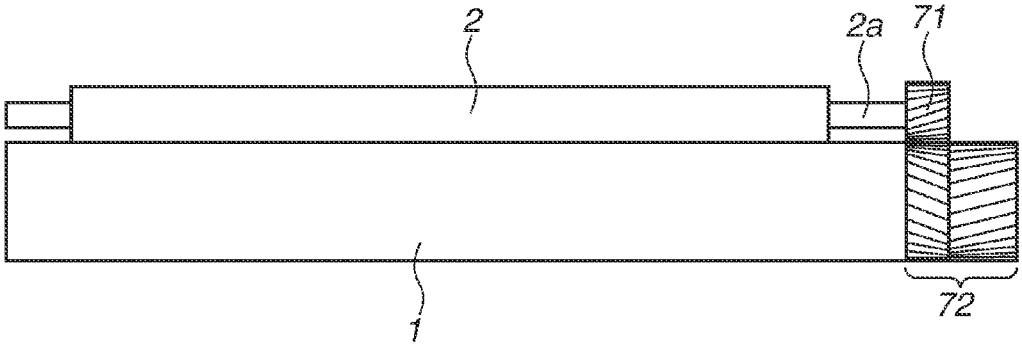
FIG. 4 illustrates a configuration in which a charging roller is driven with a difference in peripheral speed from a photosensitive drum.

In the present exemplary embodiment, in order to assure that the charging polarity of residual untransferred toner that is not successfully changed to negative by the discharging at the nip portion is reliably changed to negative to pass the residual untransferred toner through the charging portion c, the charging roller 2 is driven and rotated with a predetermined difference in peripheral speed from the photosensitive drum 1. This configuration is illustrated in FIG. 4.

The configuration is used in which the charging roller gear 71 is provided to the core metal 2*a* of the charging roller 2 and is engaged with a drum gear 72 provided to an end portion of the photosensitive drum 1. Accordingly, as the photosensitive drum 1 is rotated and driven, the charging roller 2 is also rotated and driven with the difference in peripheral speed. The peripheral speed of the surface of the charging roller 2 is set to be 115% with respect to the peripheral speed of the surface of the photosensitive drum 1.

With the difference in peripheral speed, friction occurs between the toner on the photosensitive drum 1 and the charging roller 2, whereby the polarity of the residual untransferred toner can be changed to negative. This also produces an advantage that adhesion of the toner to the charging roller 2 can be reduced.

As the foregoing describes, the polarity of toner remaining on the photosensitive drum is changed to negative immediately before the nip portion of the charging roller by the discharge conducted immediately before the entry to the nip portion of the charging roller and the friction caused by the difference in peripheral speed between the photosensitive drum and the charging roller. In this way, contamination of the charging roller in a cleanerless system is reduced.

However, there have been cases where a charging roller in a cleanerless system is contaminated when:

1. the amount of fog toner is large, or
2. the polarity of toner is not successfully changed to negative.

(Mechanism in which Fog Becomes Significant at End Portions of Charging Member)

Studies by the present inventors found that toner was more likely to satisfy the foregoing two elements at the end portions of the photosensitive drum 1 that corresponds to the end portions of the charging member.

First, the mechanism in which fog toner becomes significant at the end portions will be described.

Among the toner in the vicinity of the regulating member illustrated in FIG. 6, the toner at a central portion is consumed as an image is formed. Then, new toner in an amount that is equal to the amount of the consumed toner is supplied from a toner supplying chamber. The regulation by the regulating member is stable at the central portion, so formation of a coating layer is stably continued on the development sleeve 31.

On the other hand, the movement of the toner is restricted at the end portions due to the walls 42 of the longitudinal end portions in the development chamber 301. Furthermore, the toner is less likely to be consumed and is thus less likely to be replaced by new toner. Therefore, deterioration of the toner is more likely to develop at the end portions than at the central portion.

Furthermore, the contact pressure is more likely to escape at the end portions of a developer regulating member than at the central portion (the contact pressure is more likely to change) and a space is likely to form between the end portions and the end portion seals 41, so the regulation of the developer is likely to be unstable at the end portions.

Accordingly, the amount of deteriorated toner is larger at the end portions than at the central portion, so the amount of fog toner is likely to be large at the end portions.

(Transfer Bias-Applicable Longitudinal Width and Polarity of Fog Toner)

The following describes a mechanism in which the polarity of fog toner at the end portions changes depending on whether a transfer bias is applied.

FIG. 1 illustrates the relationship between the length Ld of the developer bearing region D, the length Lt1 of the transfer bias applicable region, and other lengths according to the present exemplary embodiment. The developer bearing region D has the width Ld across which the developer bearing member is coated with toner. Further, the transfer bias applicable region is a region on the photosensitive drum 1 to which the transfer bias is applicable by the transfer roller 5. The present exemplary embodiment employs a configuration in which the longitudinal length Ld of the developer bearing region D is set longer than the longitudinal length Lt1 of the transfer bias applicable region. In other words, the longitudinal end portions of the developer bearing region D are respectively located outside the longitudinal end portions of the transfer bias applicable region when viewed from a dotted line C at the center. Further, a magnetic field generation width Lm on the magnet roller 32 that is the width across which the magnetic field of the magnet roller 32 is generated is set wider than the width Ld of the toner coating.

The width of a charging region (region that faces the charging portion c on the surface of the photosensitive drum 1) across which the charging roller 2 is in contact with the surface of the photosensitive drum 1 is denoted by Lc. To prevent development of toner on a portion that is not electrically charged, the width Lc of the charging region is generally set wider than the width Ld.

In the present exemplary embodiment, Lc=240 mm, Ld (developer bearing region D)=226 mm, Lt1 (transfer bias applicable region)=220 mm, and Lm=230. The distance from an end of the developer bearing region to an end of the transfer bias applicable region on the same side is 3 mm (Ld−Lt1=226−220=6 mm (both ends)). In FIG. 1, the width of the letter size (width Lp=216 mm) is also specified as the sheet P to be printed.

The following describes the advantage of the present exemplary embodiment with reference to FIG. 1.

The toner on the end portions of the developer bearing region D is transferred as end portion fog toner onto the photosensitive drum 1.

As apparent from FIG. 1, regions 51 of the photosensitive drum 1 on which the end portion fog toner exists are not facing the transfer roller 5, which is a transfer unit, and are therefore not affected by the transfer bias. Thus, the amount of electrical charge of the end portion fog toner does not change even after the passing of the facing portion of the transfer unit and remains substantially equal to the amount after the development. The polarity of the end portion fog toner developed on the photosensitive drum 1 can be either of positive and negative, but the end portion fog toner exists as toner charged to the vicinity of zero on the photosensitive drum 1.

As described above, the amount of fog toner is larger at the end portions than at the center, but since the amount of electrical charge is in the vicinity of zero, the toner can be negatively charged, which is the normal polarity, by the discharge at the void immediately before the charging portion c and the friction caused by the difference in peripheral speed between the photosensitive drum 1 and the charging roller 2.

Thus, the toner is not likely to adhere to the charging roller 2 and can be collected at the developing device 3.

Figure 7:
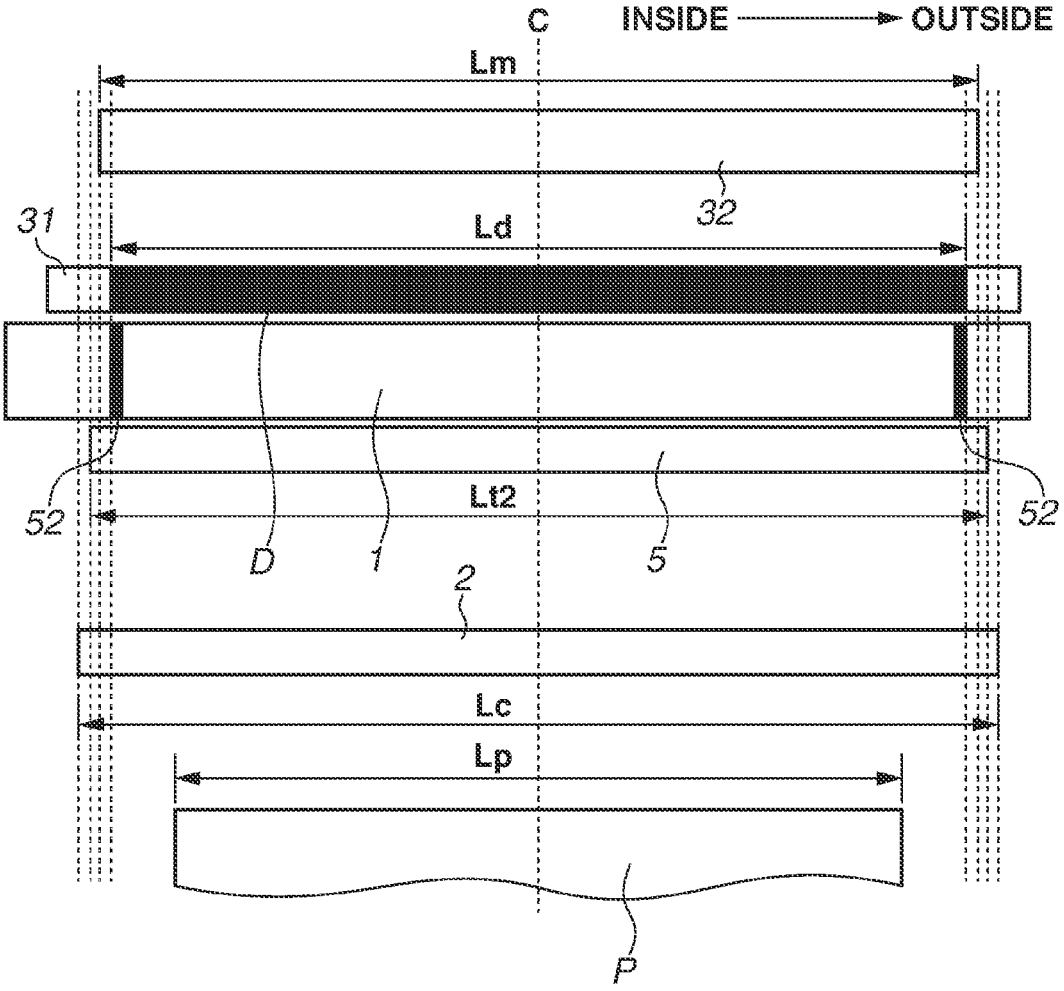
FIG.7 Prior Art
FIG. 7 illustrates a positional relationship between a charging roller, a development sleeve, a photosensitive drum, and a transfer roller according to a comparative example in comparison with the first exemplary embodiment, in the longitudinal direction.

The configuration according to a comparative example is illustrated in FIG. 7 for the comparison with the present exemplary embodiment. FIG. 7 illustrates the relationship between the developer bearing region D and the transfer bias applicable region according to the comparative example.

The longitudinal width Ld of the developer bearing region D is set shorter than the width Lt2 of the transfer bias applicable region. More specifically, the respective longitudinal end portions of the developer bearing region D are respectively located inside the longitudinal end portions of the transfer bias applicable region. The width of the developer bearing region D according to the first exemplary embodiment and the width of the developer bearing region D according to the comparative example are both Ld and exactly the same.

In the comparative example, Lc=240 mm, Ld=226 mm, and Lt2 (transfer bias applicable region)=232 mm. The distance from a longitudinal end of the transfer bias applicable region to an end of the developer bearing region D is 3 mm (Lt2−Ld=232 mm−226 mm=6 mm (both ends)). The size of a sheet P to be printed is set to the letter size (width Lp=216 mm) as in the first exemplary embodiment.

The following describes the comparative example in more detail with reference to FIG. 7.

As apparent from FIG. 7, regions 52 of the photosensitive drum 1 on which end portion fog toner exists are facing the transfer roller 5.

Thus, when an image forming operation is performed, a strong positive bias that is a transfer bias (or print bias) is applied to the end portion fog toner, whereby the toner is positively charged.

If an excessive amount of end portion fog toner is positively charged at the transfer portion, it becomes difficult to change the polarity of all the end portion fog toner to negative by the discharge conducted immediately before the surface of the image carrying member that bears the positively charged end portion fog toner enters the nip portion of the charging roller 2. Furthermore, even if the end portion fog toner is moved to the position of friction of the surface of the image carrying member against the charging roller 2, and friction occurs due to the difference in peripheral speed between the photosensitive drum 1 and the charging roller 2, it is still difficult to change the polarity of all the end portion fog toner to negative.

Thus, in the comparative example, adhesion of toner to the charging roller 2 occurred correspondingly to the position of the photosensitive drum 1 where the end portion fog was generated (regions 52 where the end portion fog toner existed).

Meanwhile, fog toner and positively charged residual untransferred toner also existed at the image center (dotted line C) to which the transfer bias of the transfer was applied. However, the amount of the fog toner and the positively charged residual untransferred toner was not significant compared to the end portions, so the polarity of substantially all the toner could be changed to negative. Thus, no adhesion to the charging roller 2 occurred.

Accordingly, by preventing application of the transfer bias to end portion fog toner that is often large in amount, much of the fog toner is prevented from being positively charged so that adhesion of the fog toner to the contact charging member is less likely to occur.

Verification of Advantage of Present Exemplary Embodiment

Printing tests of 3000 sheets were conducted using the image forming apparatuses configured to simultaneously perform development and collection according to the present exemplary embodiment and the comparative example.

As to adhesion of toner to the charging roller 2, a surface of the charging roller 2 was observed each time 200 sheets were printed, and if adhesion to the surface was confirmed, it was determined that adhesion occurred on the charging roller 2.

If the adhesion of toner on the charging roller 2 worsens, the surface of the photosensitive drum 1 can no longer be charged, and fog toner on the photosensitive drum 1 further increases to gradually increase the fog toner region. If the adhesion further increases, the fog toner becomes observable even on the end portions of the image formation region.

Thus, when contamination of the end portions was confirmed on a sheet, it was determined that contamination occurred on the sheet.

As used herein, the image formation region refers to a region on which an image is to be formed on a medium to be printed and to which a transfer bias needs to reliably be applied. Thus, the image formation region according to the present exemplary embodiment was set to 220 mm to enable transfer of an image onto the entire recording material, while the width of the letter size in a direction perpendicular to an image traveling direction (or recording material moving direction) is 216 mm.

The timings of occurrence in the present exemplary embodiment and the comparative example are shown in Table 1.

TABLE 1

| | Present exemplary embodiment | Comparative example |
|---|---|---|
| Occurrence on charging roller | Very minor | 1800 sheets |
| Occurrence on sheet | Not occurred | 2600 sheets |

In fact, in the present exemplary embodiment, no occurrence was observed on the sheet, and almost no contamination occurred on the charging roller 2. On the other hand, it can be understood that the level of contamination of the charging roller 2 in the comparative example was worse than the level of contamination of the charging roller 2 in the present exemplary embodiment and that the contamination having adhered to the charging roller 2 affected the image formation before 3000 sheets.

From the foregoing results, it was confirmed that the configuration according to the present exemplary embodiment was more advantageous than the comparative example.

In the present exemplary embodiment, the distance from each end portion of the transfer roller 5 (each end portion of transfer bias applicable region) to each widthwise end of the developer bearing region D, which is (Ld−Lt1)/2, is set to 3 mm. However, a distance that is needed varies depending on conditions such as toner, regulation of the toner, etc. and is not limited to the value specified above.

While the relationship between the longitudinal width of the developer bearing region D and the longitudinal width of the transfer bias applicable region is regulated in the present exemplary embodiment, not the relationship with the width of the developer bearing region D but the relationship with the longitudinal width Lk of the development opening S may be regulated.

Figure 8:
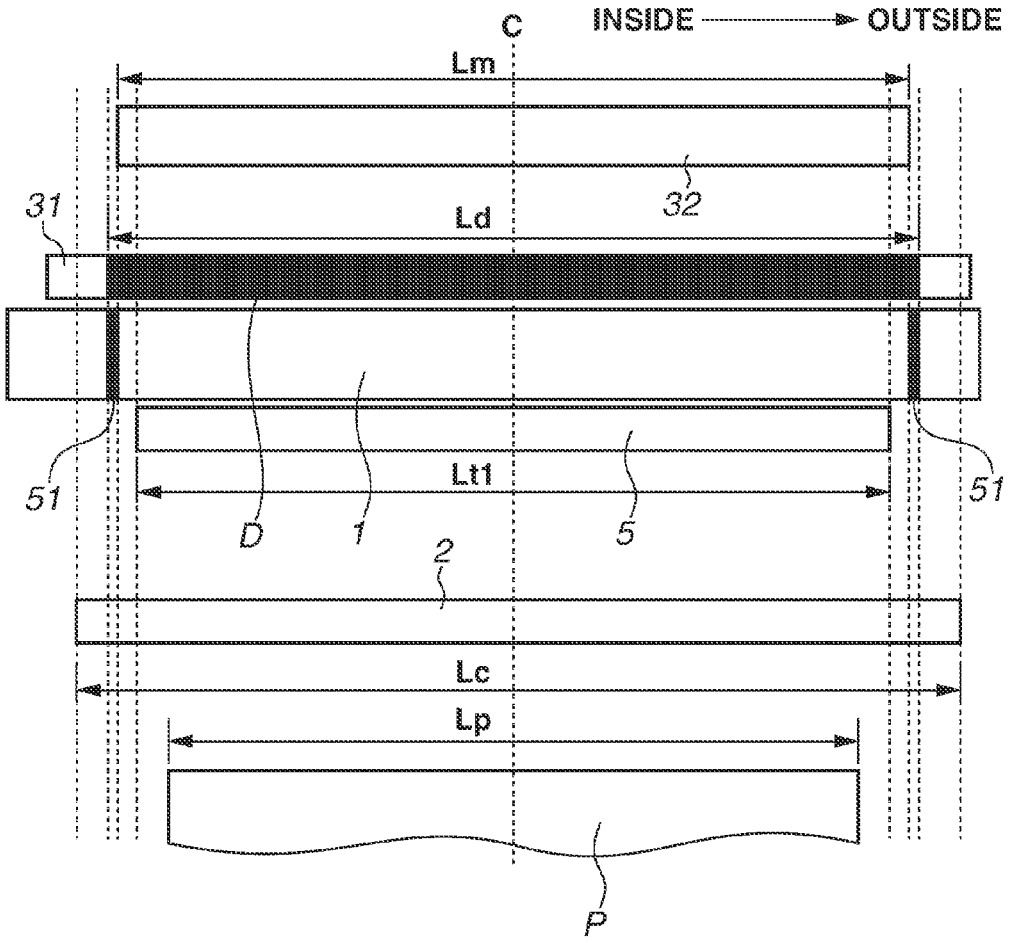
FIG. 8 illustrates a longitudinal width of a magnetic field generating member and a positional relationship of a transfer roller according to a modified example of the first exemplary embodiment, in the longitudinal direction.

The developer bearing member 34 according to the present exemplary embodiment is the development sleeve 31. The longitudinal length of the region on the development sleeve 31 that is coated with toner (developer bearing region D) does not match the longitudinal length of the magnetic field generating region of the magnet roller 32 contained in the development sleeve 31. While Lm>Ld in the present exemplary embodiment, there may be a case where Lm<Ld. This case is illustrated in FIG. 8. In the present exemplary embodiment, the longitudinal direction of the magnetic field generating region is the same direction as the longitudinal direction of the development sleeve 31.

As an example, Lc=240 mm, Ld=226 mm, and Lt1=220 mm, as in FIG. 1, and Lm=222 mm.

The supply and regulation of toner by the magnetic field are not conducted with respect to the toner coating state of the region that is not facing the magnetic field generating region of the magnet roller 32, compared to the region facing the magnetic field generating region. Thus, replacement of toner cannot be expected, and the regulation is insufficient. For this reason, the region that does not face the magnetic field generating region of the magnet roller 32 is in the state in which end portion fog is more likely to occur. More specifically, even if the width of the transfer roller 5 is decreased to be inside the width of the developer bearing region D of the development sleeve 31, there remains a possibility that a region in which the toner coating is unstable in the vicinity of the end portions of the transfer roller 5 faces the transfer bias applicable region.

Thus, as illustrated in FIG. 8, the end portions of the transfer roller 5 are respectively located inside the longitudinal end portions of the magnetic field generating region of the magnet roller 32 in which the toner coating state is stable. In this way, application of the transfer bias to a region in the developer bearing region D in which the toner state is likely to be unstable and that is less (or not) affected by the magnetic force can be prevented.

Accordingly, the longitudinal width Lt1 of the region to which the transfer bias of the transfer roller 5 is applicable is desirably shorter than the longitudinal width Lm of the magnetic field generating region of the magnet roller 32.

A second exemplary embodiment is an application to an image forming apparatus configured to simultaneously perform development and collection using nonmagnetic one-component developer (so-called cleanerless system).

(Configuration of Image Forming Apparatus)

Figure 9:
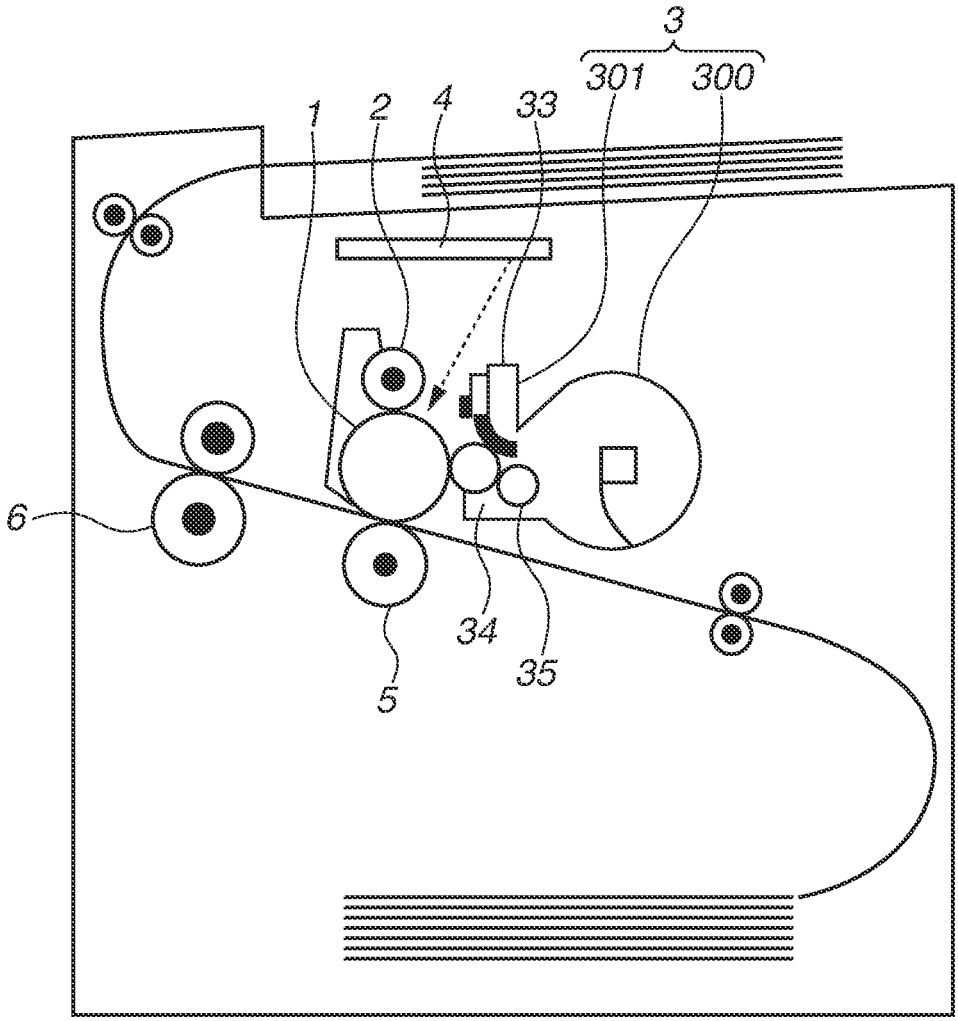
FIG. 9 is a cross sectional view illustrating an image forming apparatus according to a second exemplary embodiment.

Only points that are different from the image forming apparatus according to the first exemplary embodiment will be described, and description of points that are substantially similar is omitted. FIG. 9 illustrates a cross sectional view according to the present exemplary embodiment.

The following describes points that are different from FIG. 2 according to the first exemplary embodiment.

As to developer, negatively-charged nonmagnetic one-component developer is used.

A developer bearing member 34 configured to bear the developer has a roller structure in which an elastic layer is formed on a core metal and a surface layer is formed on a surface of the elastic layer. Thus, the developer bearing member 34 according to the present exemplary embodiment is a development roller. Further, a developer supplying member 35 is provided. The developer supplying member 35 is in contact with the developer bearing member 34 and supplies the developer to the developer bearing member 34.

The developer supplying member 35 includes a core metal and a foam layer formed on the core metal. The developer supplying member 35 supplies the developer to the developer bearing member 34 and removes, from the surface of the developer bearing member 34, the developer that has not used for development and thus remained thereon.

Operations involved in the image formation are not significantly different from the operations of the image forming apparatus according to the first exemplary embodiment.

(Location of Developer Supplying Member)

Figure 10:
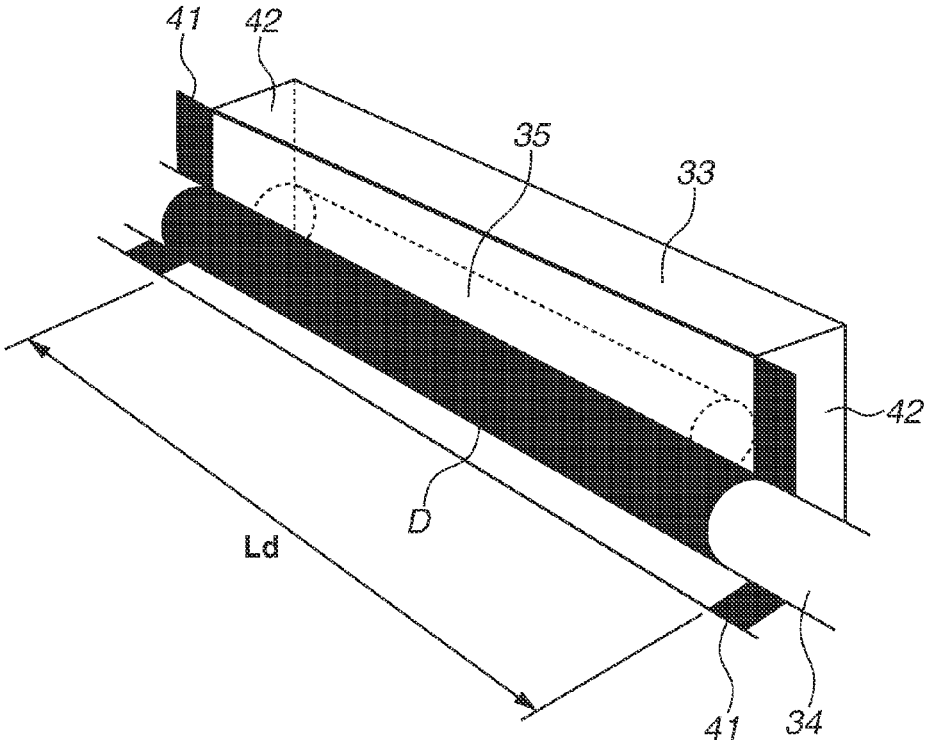
FIG. 10 illustrates an arrangement in which a developer bearing member, a development blade, and a supplying member are attached to a development chamber.

FIG. 10 is a perspective view illustrating a development chamber 301 to which the developer bearing member 34, a development blade 33, and the developer supplying member (dotted line) 35 are attached.

FIG. 10 is different from FIG. 6 according to the first exemplary embodiment in that the developer supplying member 35 is in contact with a surface of the developer bearing member 34 on the side that is not exposed to the outside from a development opening S.

(Relationship between Longitudinal Widths of Respective Components)

Figure 11:
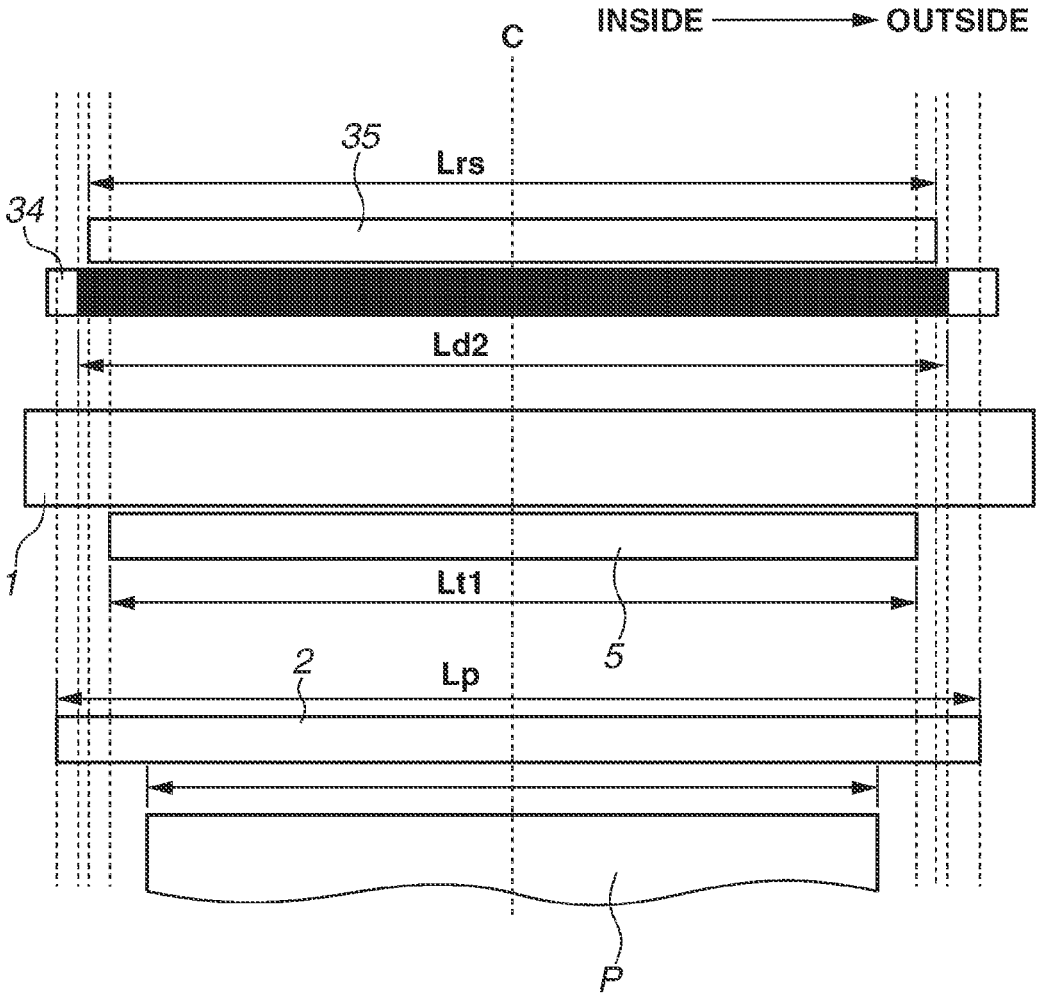
FIG. 11 illustrates a positional relationship between a charging roller, a developer bearing member, a supplying member, a photosensitive drum, and a transfer roller according to the second exemplary embodiment, in the longitudinal direction.

FIG. 11 illustrates the positional relationship between a photosensitive drum 1 and a developer bearing region (Ld2), a transfer bias applicable region (Lt1), and a width (Lrs) across which the developer supplying member is in contact with the developer bearing member 34 according to the present exemplary embodiment.

The length of the developer bearing region of the nonmagnetic one-component developer on the developer bearing member 34 is denoted by Ld2, and the width (supplying member contact region) across which the developer supplying member 35 is in contact with the developer bearing member 34 is denoted by Lrs. In this case, each of the length Ld2 of the developer bearing region and the width Lrs of the supplying member contact region is set longer than the longitudinal width Lt1 of the region (transfer bias applicable region) to which a transfer bias is applicable by the transfer roller 5.

In the present exemplary embodiment, the relationship between the longitudinal length Ld2 of the developer bearing region and the longitudinal length Lrs of the contact region that is in contact with the developer supplying member 35 is set to Ld2>Lrs. In the present exemplary embodiment, the longitudinal direction of the contact region is the same direction as the longitudinal direction of the developer bearing member 34.

Thus, at portions of end portions of the developer bearing member 34 that are not in contact with the developer supplying member 35, removal of the developer from a surface of the developer bearing member 34 and the supply of the developer may be insufficient and, therefore, the portions may be unstable. Thus, the relationship is set to Lrs>Lt1 to prevent application of the transfer bias to fog toner on the region where the coating state of the developer is unstable.

The foregoing can reduce contamination of the charging roller by fog toner on the end portions.

While the toner that is magnetic one-component developer is described in the first exemplary embodiment and the toner that is nonmagnetic developer is described in the second exemplary embodiment, these are not limiting examples. Two-component developer may be used depending on the configuration. For example, magnetic two-component developer containing a carrier and magnetic toner may be used.

While the charging roller is used as a charging member in an exemplary embodiment described above, this is not a limiting example. Any configuration may be used in which a charging member is in contact with an image carrying member and, for example, the charging member may be in the shape of a belt.

While the transfer roller is used as a transfer member in an exemplary embodiment described above, this is not a limiting example. For example, in an image forming apparatus using an intermediate transfer belt, etc., the intermediate transfer belt may have the transfer function.

While the configuration in which the process cartridge is attachable to and detachable from an apparatus main body is described in an exemplary embodiment described above, a developing device may be attachable to and detachable from an apparatus main body. In this case, an image carrying member and a charging member may be fixed to an apparatus main body, or an image carrying member and a charging member may form an image carrying member cartridge (drum cartridge). In this case, the drum cartridge is separately attachable to and detachable from a developing device that includes a developer bearing member.

An exemplary embodiment of the present invention is capable of reducing contamination of a contact charging member.

While aspects of the present invention have been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176064, filed Sep. 7, 2015, which is hereby incorporated by reference herein in its entirety.

What is claimed is:

1. An image forming apparatus comprising:

an image carrying member;

a charging member configured to come into contact with the image carrying member and electrically charge a surface of the image carrying member;

a developer bearing member configured to collect developer remaining on the image carrying member after a developed image formed on the image carrying member has been transferred onto a recording material; and a transfer member configured to transfer the developed image onto the recording material, wherein the developer bearing member has a developer bearing region that bears developer, wherein the transfer member has a transfer bias applicable region to which a transfer bias is applicable, and wherein, in a longitudinal direction of the developer bearing member, end portions of the developer bearing region are respectively located outside end portions of the transfer bias applicable region and inside end portions of a charging region where the charging member and the image carrying member are in contact with each other.

2. The image forming apparatus according to claim 1, wherein, in the longitudinal direction, a width of the developer bearing region is longer than a width of the transfer bias applicable region.

3. The image forming apparatus according to claim 1, wherein the developer bearing member is a development sleeve, and wherein the development sleeve contains a magnetic field generating member.

4. The image forming apparatus according to claim 3, wherein, in the longitudinal direction, end portions of the magnetic field generating member are respectively located at positions that are outside the end portions of the transfer bias applicable region and outside the developer bearing region.

5. The image forming apparatus according to claim 3, wherein, in the longitudinal direction, end portions of the magnetic field generating member are respectively located at positions that are outside the end portions of the transfer bias applicable region and inside the developer bearing region.

6. The image forming apparatus according to claim 1, further comprising a supplying member configured to supply developer to the developer bearing member.

7. The image forming apparatus according to claim 1, further comprising an image carrying member cartridge including the image carrying member and the charging member, wherein the image carrying member cartridge is attachable to and detachable from an apparatus main body of the image forming apparatus separately from the developer bearing member.

8. The image forming apparatus according to claim 1, wherein the developer is one-component developer.

9. An image forming apparatus comprising:

an image carrying member;

a charging member configured to come into contact with the image carrying member and electrically charge a surface of the image carrying member;

a developing device including a developer bearing member configured to bear developer, and an opening through which stored developer is supplied to the developer bearing member, the developing device collecting developer remaining on the image carrying member after a developed image formed on the image carrying member has been transferred onto a recording material; and a transfer member configured to transfer the developed image onto the recording material, wherein the transfer member has a transfer bias applicable region to which a transfer bias is applicable, and wherein, in a longitudinal direction of the developer bearing member, end portions of the opening are respectively located outside end portions of the transfer bias applicable region and inside end portions of a charging region where the charging member and the image carrying member are in contact with each other.

10. The image forming apparatus according to claim 9, wherein, in the longitudinal direction, a width of the opening is longer than a width of the transfer bias applicable region.

11. The image forming apparatus according to claim 9, wherein the developer bearing member is a development sleeve, and wherein the development sleeve contains a magnetic field generating member.

12. The image forming apparatus according to claim 11, wherein, in the longitudinal direction, end portions of the magnetic field generating member are respectively located at positions that are outside the end portions of the transfer bias applicable region and outside the developer bearing region.

13. The image forming apparatus according to claim 11, wherein, in the longitudinal direction, end portions of the magnetic field generating member are respectively located at positions that are outside the end portions of the transfer bias applicable region and inside the developer bearing region.

14. The image forming apparatus according to claim 9, further comprising a supplying member configured to supply developer to the developer bearing member.

15. The image forming apparatus according to claim 9, further comprising an image carrying member cartridge including the image carrying member and the charging member, wherein the image carrying member cartridge is attachable to and detachable from an apparatus main body of the image forming apparatus separately from the developer bearing member.

16. The image forming apparatus according to claim 9, wherein the developer is one-component developer.

17. A developing device configured to collect developer remaining on an image carrying member after a developed image formed on the image carrying member has been transferred onto a recording material by a transfer member, the developing device comprising:

a developer bearing member having a developer bearing region that bears developer; and a frame member configured to store developer to be supplied to the developer bearing member, wherein, the developer bearing member is configured such that in a longitudinal direction of the developer bearing member, end portions of the developer bearing region are respectively located outside end portions of a transfer bias applicable region to which a transfer bias is applicable on the transfer member, and located inside end portions of a charging region where a charging member and the image carrying member are in contact with each other.

18. A process cartridge comprising:

the developing device according to claim 17; and an image carrying member.

19. A developing device configured to collect developer remaining on an image carrying member after a developed image formed on the image carrying member has been transferred onto a recording material by a transfer member, the developing device comprising:

a developer bearing member configured to bear developer; and a frame member including an opening and configured to store developer to be supplied to the developer bearing member, wherein, the developer bearing member is configured such that in a longitudinal direction of the developer bearing member, end portions of the opening are respectively located outside end portions of a transfer bias applicable region to which a transfer bias is applicable on the transfer member, and located inside end portions of a charging region where a charging member and the image carrying member are in contact with each other.

20. A process cartridge comprising:

the developing device according to claim 19; and an image carrying member.

* * * * *